US012590352B2

(12) United States Patent
Luo et al.

(10) Patent No.: US 12,590,352 B2
(45) Date of Patent: Mar. 31, 2026

(54) AMMONIUM COMPLEX SYSTEM-BASED METHOD FOR SEPARATING AND PURIFYING LEAD, ZINC, CADMIUM, AND COPPER

(71) Applicant: GREENNOVO ENVIRONMENTAL TECHNOLOGY CO., LTD., Honghe (CN)

(72) Inventors: Yan Luo, Honghe (CN); Liyang Ma, Honghe (CN); Guojun Feng, Honghe (CN); Wu Zhang, Honghe (CN); Rui Chen, Honghe (CN); Qinglong Ma, Honghe (CN)

(73) Assignee: GREENNOVO ENVIRONMENTAL TECHNOLOGY CO., LTD., Honghe (CN)

( * ) Notice: Subject to any disclaimer, the term of this patent is extended or adjusted under 35 U.S.C. 154(b) by 857 days.

(21) Appl. No.: 17/914,278

(22) PCT Filed: Dec. 28, 2020

(86) PCT No.: PCT/CN2020/140100
§ 371 (c)(1),
(2) Date: Jan. 6, 2023

(87) PCT Pub. No.: WO2021/190025
PCT Pub. Date: Sep. 30, 2021

(65) Prior Publication Data

US 2023/0124749 A1 Apr. 20, 2023

(30) Foreign Application Priority Data

Mar. 24, 2020 (CN) ..... 202010214067.0

(51) Int. Cl.
*C25C 7/00* (2006.01)
*C22B 3/00* (2006.01)
(Continued)

(52) U.S. Cl.
CPC ..... *C22B 3/14* (2013.01); *C22B 3/22* (2013.01); *C22B 19/24* (2013.01); *C25C 1/16* (2013.01)

(58) Field of Classification Search
CPC .. C22B 3/14; C22B 3/22; C22B 19/24; C25C 1/16
See application file for complete search history.

(56) References Cited

U.S. PATENT DOCUMENTS

2009/0272227 A1 11/2009 Creasey et al.

FOREIGN PATENT DOCUMENTS

CN 1046761 A 11/1990
CN 1093418 A 10/1994
(Continued)

OTHER PUBLICATIONS

International Search Report dated Mar. 31, 2021, in International Patent Application No. PCT/CN2020/140100, pp. 1-5.
(Continued)

*Primary Examiner* — Zulmariam Mendez
(74) *Attorney, Agent, or Firm* — Byrne Poh LLP; Nina R. Horan

(57) ABSTRACT

An ammonium complex system-based method for separating and purifying lead, zinc, cadmium, and copper, comprising the following steps: a zinc-containing raw material is leached using a leach solution to produce a leached solution; a filtrate and a filter residue are produced by filtration; the filtrate is mixed with metal lead to displace copper, undergoes a solid-liquid separation to produce a first separated liquid, is mixed with metal cadmium to displace lead, undergoes a solid-liquid separation to produce a second separated liquid, is mixed with metal zinc to displace cadmium, and undergoes a solid-liquid separation to produce a third separated liquid; and, the third separated liquid
(Continued)

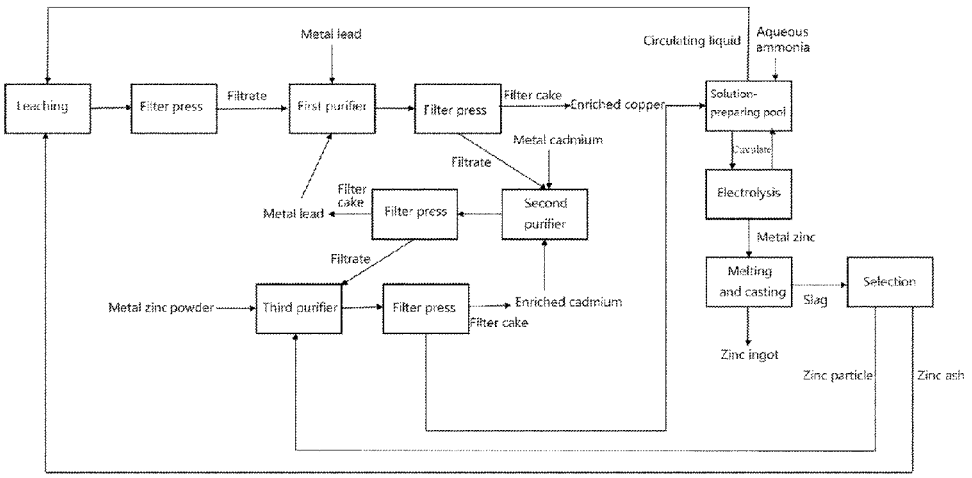

is electrolyzed to produce metal zinc, and an electrolytic solution is returned to the leaching step.

14 Claims, 1 Drawing Sheet

(51) Int. Cl.

| | |
|---|---|
| ***C22B 3/14*** | (2006.01) |
| ***C22B 3/22*** | (2006.01) |
| ***C25C 1/16*** | (2006.01) |

(56) References Cited

FOREIGN PATENT DOCUMENTS

| | | | | |
|---|---|---|---|---|
| CN | 101928827 | A | | 12/2010 |
| CN | 102517455 | A | | 6/2012 |
| CN | 103757420 | A | | 4/2014 |
| CN | 104451172 | A | | 3/2015 |
| CN | 104805468 | A | | 7/2015 |
| CN | 105197982 | A | | 12/2015 |
| CN | 108277345 | A | | 7/2018 |
| CN | 109055739 | | * | 12/2018 |
| CN | 111286609 | A | | 6/2020 |

OTHER PUBLICATIONS

Office Action dated Apr. 13, 2021 in CN Patent Application No. 202010214067.0, pp. 1-12.
Office Action dated Oct. 13, 2021 in CN Patent Application No. 202010214067.0, pp. 1-12.

* cited by examiner

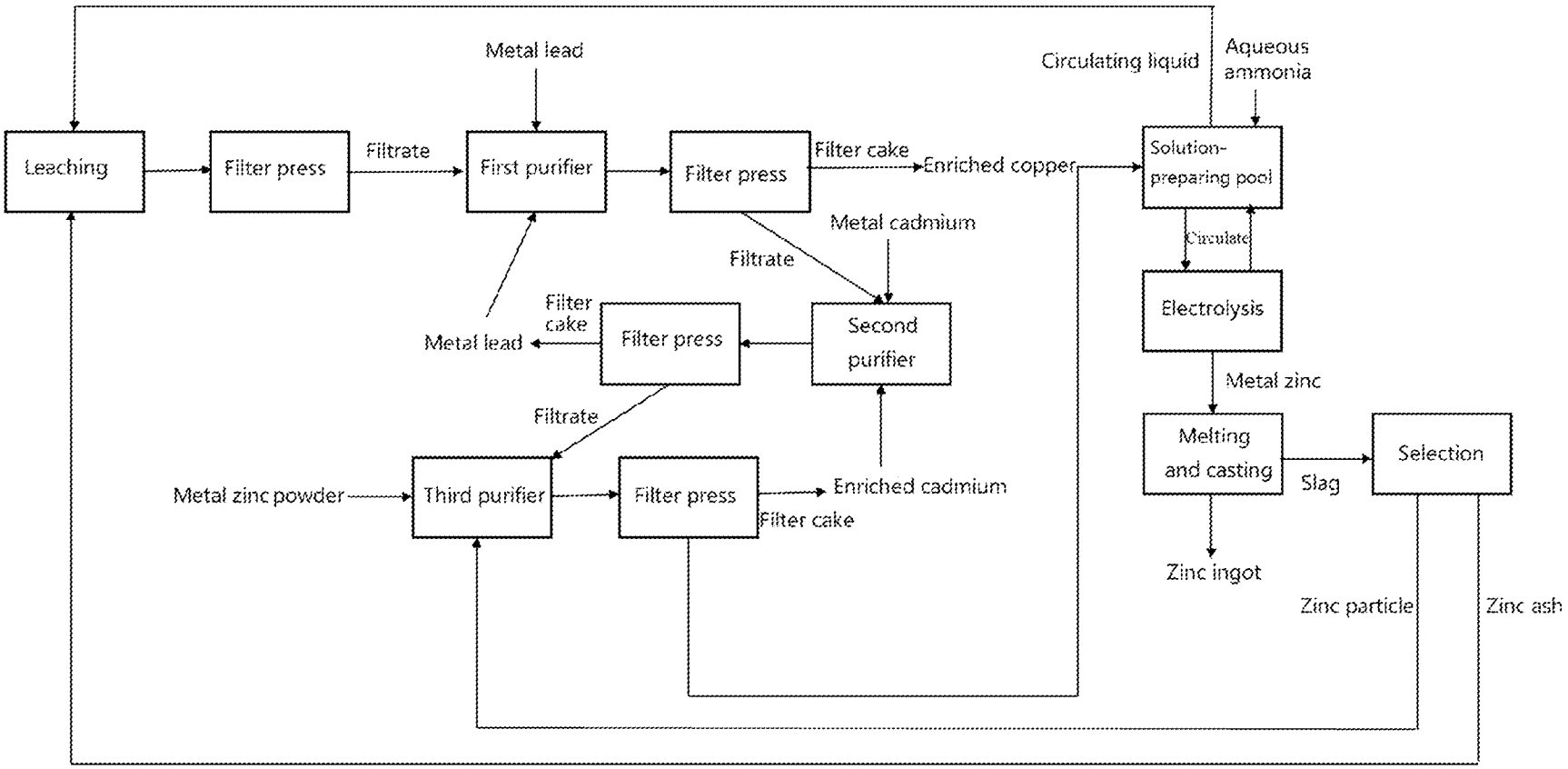
Leaching
Filter press
Filtrate
First purifier
Metal lead
Filter press
Filter cake
Enriched copper
Circulating liquid
Solution-preparing pool
Aqueous ammonia
Circulate
Electrolysis
Metal zinc
Melting and casting
Zinc ingot
Slag
Selection
Zinc ash
Zinc particle
Filtrate
Second purifier
Metal cadmium
Filter press
Filter cake
Metal lead
Filtrate
Third purifier
Metal zinc powder
Filter press
Filter cake
Enriched cadmium

AMMONIUM COMPLEX SYSTEM-BASED METHOD FOR SEPARATING AND PURIFYING LEAD, ZINC, CADMIUM, AND COPPER

TECHNICAL FIELD

The present application belongs to the field of electrolytic zinc production, and relates to a method for separating and purifying lead, zinc, cadmium and copper, and for example, an ammonium complex system-based method for separating and purifying lead, zinc, cadmium and copper.

BACKGROUND

At present, about 80% of the zinc in the world is extracted by wet process, and the purification of zinc-pregnant leach solution is one of the key processes of the whole process. Impurities such as copper, lead and cadmium in the leach solution not only damage the quality of the electrodeposited zinc on cathode greatly, but also reduce the current efficiency and increase energy consumption. Therefore, it is very important to effectively purify the leach solution before the electrodeposition.

CN107385472A discloses a production method of electrolytic zinc, in which a purification process is divided into a first-stage purification, a second-stage purification and a third-stage purification; the first-stage purification includes the process: according to an impurity content, zinc powder is added into a purification barrel with an amount of 1.2-1.5 times the content of cadmium and copper, a liquid temperature is kept at 80-90° C., and copper sulfate and potassium permanganate react for 1 h; the second-stage purification includes the process: the zinc powder and potassium permanganate are continually added into the purification barrel, water vapor is also injected, and the liquid is kept at a temperature of 80-90° C. and reacts for 1.5 h; the third-stage purification includes the process: a purifying agent is added into the filtrate obtained from the first-stage purification and the second-stage purification to remove Co and Ni, and after a reaction of 40 min, a zinc liquid is obtained, and the zinc liquid obtained after the three purification processes is temporarily stored and cooled in a storage tank of purification liquid and then pumped into a zinc liquid pool. The purification process is mainly used for zinc production by acid method, and not suitable for zinc extraction by ammonia method.

CN209669311U discloses an electrolytic zinc production system using electric energy generated by waste heat obtained from steel low-zinc ash hazardous waste, in which the purification filter press mechanism includes a rough purification device, a third filter press device, a secondary purification device and a fourth filter press device; a material inlet of the rough purification device is connected to a filtrate outlet of a first leach filter press mechanism, and the rough purification device is also provided with a rough purification zinc inlet, which is used for feeding zinc particles or zinc powders into the rough purification device; a material outlet of the rough purification device is connected to a material inlet of the third filter press device, a filtrate outlet of the third filter press device is connected to a material inlet of the secondary purification device, a material outlet of the secondary purification device is connected to the fourth filter press device, and a filtrate outlet of the fourth filter press device is connected to an electrolysis device; the secondary purification device is provided with a secondary purification zinc inlet, which is used for feeding ultra-pure fine zinc powders into the secondary purification device.

None of the above literatures have obtained copper, lead, cadmium and other metals with high purity, and the obtained lead and cadmium metals have not been reused for the impurity removal of purification liquid, so that the consumption of zinc powder is relatively large.

In the existing large-scale production of electrolytic zinc by ammonia method, a Zn(II)-$NH_3$—$NH_4Cl$—$H_2O$ system is usually used, and zinc powder is used to intermittently remove impurity elements such as copper, lead and cadmium. Such process can obtain lead slag with a content of 30-50%, which has a low grade in lead-containing and lots of impurities, and fails to maximize the value of lead. The obtained copper, cadmium and lead have the similar circumstance; meanwhile, the utilization rate of zinc is less than 60% when zinc powder is used for removing impurities, leading to high costs of removing impurities.

SUMMARY

An object of the present application is to provide an ammonium complex system-based method for separating and purifying lead, zinc, cadmium and copper, and the lead and cadmium produced by the method are used back in the method, realizing the integration of production and utilization, and reducing production costs.

In order to achieve the object, the following technical solutions are used in the present application.

The present application provides an ammonium complex system-based method for separating and purifying lead, zinc, cadmium and copper, and the method includes the following steps:

(1) leaching a zinc-containing raw material with a leach solution, so as to obtain a extracting solution;

(2) filtering the extracting solution obtained in step (1), so as to obtain a filtrate and a filter residue;

(3) mixing the filtrate obtained in step (2) with metal lead to displace copper, and performing a solid-liquid separation to obtain a first separated liquid; mixing the first separated liquid with metal cadmium to displace lead, and performing a solid-liquid separation to obtain a second separated liquid; mixing the second separated liquid with metal zinc to displace cadmium, and performing a solid-liquid separation to obtain a third separated liquid;

(4) electrolyzing the third separated liquid obtained in step (3) to obtain metal zinc, and subjecting an electrolytic solution after the electrolysis back to step (1) to leach the zinc-containing raw material.

As an optional technical solution of the present application, the leach solution in step (1) includes a complexing agent.

Optionally, the complexing agent includes aqueous ammonia and/or liquid ammonia.

Optionally, a complexing agent is added to the leach solution until a pH value of the leach solution is 3.5-8, such as 4, 4.5, 5, 5.5, 6, 6.5, 7 or 7.5; however, the pH value is not limited to the listed values, and other unlisted values within the numerical range can be applied as well.

Optionally, a mass ratio of the zinc-containing raw material to the leach solution is determined according to a Zn content of an outlet purification solution being 45-120 g/L, such as 50 g/L, 55 g/L, 66 g/L, 65 g/L, 75 g/L, 85 g/L, 95 g/L, 105 g/L or 115 g/L; however, the Zn content is not limited to the listed values, and other unlisted values within the numerical range can be applied as well; the Zn content is optionally 50-90 g/L, and further optionally 70 g/L.

Optionally, a liquid-solid ratio (mass ratio) is 8-20:1 in the leaching stage of the zinc-containing raw material, such as 8:1, 9:1, 10:1, 11:1, 12:1, 14:1, 15:1, 16:1 or 19:1; however, the liquid-solid ratio is not limited to the listed values, and other unlisted values within the numerical range can be applied as well.

As an optional technical solution of the present application, a method of the filtration in step (2) is a plate and frame filter press.

Optionally, the plate and frame filter press includes a first plate and frame filter press and a second plate and frame filter press.

Optionally, a filtrate obtained by the first plate and frame filter press is subjected to step (3), a filter residue obtained is subjected to residue washing and the second plate and frame filter press sequentially, and a filtrate obtained by the second plate and frame filter press is subjected to step (3).

In the present application, the filtration is a rough filtration, and the extracting solution is injected into the rough filtration process using a slurry pump. The rough filtration process includes a first-stage plate and frame filter press, a stirring tank, a slurry pump and a second-stage plate and frame filter press. A filtrate obtained from the extracting solution through the first-stage plate and frame filter press is subjected to a purification process, and a filter residue is delivered to the stirring tank for stirring with water supplement, and then delivered to the second-stage plate and frame filter press. The obtained filtrate is subjected to a purification process, and the filter residue is delivered back to a rotating kiln for use as a raw material.

As an optional technical solution of the present application, an addition amount of metal lead in step (3) is 0.25-0.3 times a mass of copper in the filtrate in step (2), such as 0.26 times, 0.27 times, 0.28 times or 0.29 times; however, the multiple is not limited to the listed values, and other unlisted values within the numerical range can be applied as well.

As an optional technical solution of the present application, an addition amount of metal cadmium in step (3) is 0.5-0.8 times a mass of lead in the first separated liquid, such as 0.6 times, 0.65 times, 0.7 times or 0.75 times; however, the multiple is not limited to the listed values, and other unlisted values within the numerical range can be applied as well.

As an optional technical solution of the present application, an addition amount of metal zinc in step (3) is 3-10 times a mass of cadmium in the second separated liquid, such as 4 times, 5 times, 6 times, 7 times, 8 times or 9 times; however, the multiple is not limited to the listed values, and other unlisted values within the numerical range can be applied as well.

In the present application, the reaction of displacing copper with lead in step (3) is performed in a first purifier, the reaction of displacing lead with cadmium in step (3) is performed in a second purifier, and the reaction of displacing cadmium with zinc in step (3) is performed in a third purifier. In the reaction, the cadmium and lead added in step (3) are preferentially selected from the metal cadmium and lead produced by the present application. The displacement reaction in step (3) of the present application is not limited to being performed in the purifier, but can also be performed in other reaction equipment.

As an optional technical solution of the present application, a pH value of the electrolytic solution is 3.5-8 in the electrolysis in step (4), such as 3.5, 4.5, 5.5, 6.5 or 7.5; however, the pH value is not limited to the listed values, and other unlisted values within the numerical range can be applied as well.

As an optional technical solution of the present application, step (5) is further performed after step (4), in which the metal zinc obtained in step (4) is melted and cast to obtain zinc ingots and slags.

As an optional technical solution of the present application, the slags in step (5) are subjected to a selection to obtain zinc ash and zinc particles, the zinc ash is subjected to step (1) for leaching, and the zinc particles are subjected back to step (3) to displace cadmium.

As an optional technical solution of the present application, the ammonium complex system-based method for separating and purifying lead, zinc, cadmium, and copper includes the following steps:

(1) leaching a zinc-containing raw material with a leach solution, in which the leach solution includes aqueous ammonia and/or liquid ammonia, so as to obtain a extracting solution;

(2) subjecting the extracting solution obtained in step (1) to a plate and frame filter press, in which the plate and frame filter press includes a first plate and frame filter press and a second plate and frame filter press, a filtrate obtained by the first plate and frame filter press is subjected to step (3), a filter residue obtained is subjected to residue washing and the second plate and frame filter press sequentially, and a filtrate obtained by the second plate and frame filter press is subjected to step (3);

(3) mixing the filtrate obtained in step (2) with metal lead to displace copper, in which an addition amount of metal lead is 0.25-0.3 times a mass of copper in the filtrate in step (2), and performing a solid-liquid separation to obtain a first separated liquid; mixing the first separated liquid with metal cadmium to displace lead, in which an addition amount of metal cadmium is 0.5-0.8 times a mass of lead in the first separated liquid, and performing a solid-liquid separation to obtain a second separated liquid; mixing the second separated liquid with metal zinc to displace cadmium, in which an addition amount of metal zinc is 3-10 times a mass of cadmium in the second separated liquid, and performing a solid-liquid separation to obtain a third separated liquid;

(4) electrolyzing the third separated liquid obtained in step (3) to obtain metal zinc, in which a pH value of an electrolytic solution is 3.5-8 in the electrolysis, and subjecting the electrolytic solution after the electrolysis back to step (1) to leach the zinc-containing raw material;

(5) melting and casting the metal zinc obtained in step (4) to obtain zinc ingots and slags, in which the slags are subjected to a selection to obtain zinc ash and zinc particles, the zinc ash is subjected back to step (1) for leaching, and the zinc particles are subjected back to step (3) to displace cadmium.

Compared with the prior art, the present application has the following beneficial effects.

(1) According to the different electrode potentials of metal ions, different metal ions are selectively reduced stepwise in multiple stages in the present application.

(2) By accurately controlling the addition of lead, cadmium and zinc, the lead and cadmium produced in the present application are used back in the present application, and gradually replace the lead powders and cadmium powders purchased, realizing the integration of production and utilization, and reducing production costs.

BRIEF DESCRIPTION OF DRAWINGS

FIG. 1 is a schematic diagram of a system provided in Example 1 of the present application for capturing low-boiling point heavy metals from zinc-containing solid waste by combining separation with ammonium complex.

DETAILED DESCRIPTION

In order to better illustrate the present application and facilitate the understanding of the technical solutions of the present application, the present application will be further described in detail hereinafter. However, the following embodiments are only simple examples of the present application, and do not represent or limit the protection scope of the claims of the present application. The protection scope of the present application is defined by the appended claims.

The typical but non-limiting examples of the present application are described below.

EXAMPLE 1

This example provides an ammonium complex system-based method for separating and purifying lead, zinc, cadmium and copper, the process flow of which is shown in FIG. 1, and the method includes the following steps:

(1) a zinc-containing raw material was leached with a leach solution, in which the leach solution contained aqueous ammonia and had a pH of 7, so as to obtain a extracting solution, and a zinc content of the extracting solution was 70 g/L, and a liquid-solid mass ratio was 12:1 in the leaching stage of the zinc raw material;

(2) the extracting solution obtained in step (1) was subjected to a plate and frame filter press, in which the plate and frame filter press included a first plate and frame filter press and a second plate and frame filter press, a filtrate obtained by the first plate and frame filter press was subjected to step (3), a filter residue obtained was subjected to residue washing and the second plate and frame filter press sequentially, and a filtrate obtained by the second plate and frame filter press was subjected to step (3);

(3) the filtrate obtained in step (2) was mixed with metal lead to displace copper, in which an addition amount of metal lead was 0.25 times a mass of copper in the filtrate in step (2), and a solid-liquid separation was performed to obtain a first separated liquid; the first separated liquid was mixed with metal cadmium to displace lead, in which an addition amount of metal cadmium was 0.6 times a mass of lead in the first separated liquid, and a solid-liquid separation was performed to obtain a second separated liquid; the second separated liquid was mixed with metal zinc to displace cadmium, in which an addition amount of metal zinc was 7 times a mass of cadmium in the second separated liquid, and a solid-liquid separation was performed to obtain a third separated liquid;

(4) the third separated liquid obtained in step (3) was electrolyzed to obtain metal zinc, in which a pH value of an electrolytic solution was 7 in the electrolysis, and the electrolytic solution after the electrolysis was subjected back to step (1) to leach the zinc-containing raw material; and (5) the metal zinc obtained in step (4) was melted and cast to obtain zinc ingots and slags, in which the slags were subjected to a selection to obtain zinc ash and zinc particles, the zinc ash was subjected back to step (1) for leaching, and the zinc particles were subjected back to step (3) to displace cadmium.

EXAMPLE 2

This example provides an ammonium complex system-based method for separating and purifying lead, zinc, cadmium and copper, the process flow of which is shown in FIG. 1, and the method includes the following steps:

(1) a zinc-containing raw material was leached with a leach solution, in which the leach solution contained aqueous ammonia and had a pH of 6.5, so as to obtain a extracting solution, and a zinc content of the extracting solution was 65 g/L, and a liquid-solid mass ratio was 13:1 in the leaching stage of the zinc raw material;

(2) the extracting solution obtained in step (1) was subjected to a plate and frame filter press, in which the plate and frame filter press included a first plate and frame filter press and a second plate and frame filter press, a filtrate obtained by the first plate and frame filter press was subjected to step (3), a filter residue obtained was subjected to residue washing and the second plate and frame filter press sequentially, and a filtrate obtained by the second plate and frame filter press was subjected to step (3);

(3) the filtrate obtained in step (2) was mixed with metal lead to displace copper, in which an addition amount of metal lead was 0.3 times a mass of copper in the filtrate in step (2), and a solid-liquid separation was performed to obtain a first separated liquid; the first separated liquid was mixed with metal cadmium to displace lead, in which an addition amount of metal cadmium was 0.7 times a mass of lead in the first separated liquid, and a solid-liquid separation was performed to obtain a second separated liquid; the second separated liquid was mixed with metal zinc to displace cadmium, in which an addition amount of metal zinc was 6 times a mass of cadmium in the second separated liquid, and a solid-liquid separation was performed to obtain a third separated liquid;

(4) the third separated liquid obtained in step (3) was electrolyzed to obtain metal zinc, in which a pH value of an electrolytic solution was 6.5 in the electrolysis, and the electrolytic solution after the electrolysis was subjected back to step (1) to leach the zinc-containing raw material; and (5) the metal zinc obtained in step (4) was melted and cast to obtain zinc ingots and slags, in which the slags were subjected to a selection to obtain zinc ash and zinc particles, the zinc ash was subjected back to step (1) for leaching, and the zinc particles were subjected back to step (3) to displace cadmium.

EXAMPLE 3

This example provides an ammonium complex system-based method for separating and purifying lead, zinc, cadmium and copper, the process flow of which is shown in FIG. 1, and the method includes the following steps:

(1) a zinc-containing raw material was leached with a leach solution, in which the leach solution contained aqueous ammonia and had a pH of 7.5, so as to obtain a extracting solution, and a zinc content of the extracting solution was 60 g/L, and a liquid-solid mass ratio was 15:1 in the leaching stage of the zinc raw material;

(2) the extracting solution obtained in step (1) was subjected to a plate and frame filter press, in which the plate and frame filter press included a first plate and frame filter press and a second plate and frame filter press, a filtrate obtained by the first plate and frame filter press was subjected to step (3), a filter residue obtained was subjected to residue washing and the second plate and frame filter press sequentially, and a filtrate obtained by the second plate and frame filter press was subjected to step (3);

(3) the filtrate obtained in step (2) was mixed with metal lead to displace copper, in which an addition amount of metal lead was 0.28 times a mass of copper in the filtrate in step (2), and a solid-liquid separation was performed to obtain a first separated liquid; the first separated liquid was mixed with metal cadmium to displace lead, in which an addition amount of metal cadmium was 0.75 times a mass of lead in the first separated liquid, and a solid-liquid separation was performed to obtain a second separated liquid; the second separated liquid was mixed with metal zinc to displace cadmium, in which an addition amount of metal zinc was 9 times a mass of cadmium in the second separated liquid, and a solid-liquid separation was performed to obtain a third separated liquid;

(4) the third separated liquid obtained in step (3) was electrolyzed to obtain metal zinc, in which a pH value of an electrolytic solution was 7.5 in the electrolysis, and the electrolytic solution after the electrolysis was subjected back to step (1) to leach the zinc-containing raw material; and (5) the metal zinc obtained in step (4) was melted and cast to obtain zinc ingots and slags, in which the slags were subjected to a selection to obtain zinc ash and zinc particles, the zinc ash was subjected back to step (1) for leaching, and the zinc particles were subjected back to step (3) to displace cadmium.

EXAMPLE 4

This example provides an ammonium complex system-based method for separating and purifying lead, zinc, cadmium and copper, the process flow of which is shown in FIG. 1, and the method includes the following steps:

(1) a zinc-containing raw material was leached with a leach solution, in which the leach solution contained aqueous ammonia and had a pH of 5.5, so as to obtain a extracting solution, and a zinc content of the extracting solution was 50 g/L, and a liquid-solid mass ratio was 18:1 in the leaching stage of the zinc raw material;

(2) the extracting solution obtained in step (1) was subjected to a plate and frame filter press, in which the plate and frame filter press included a first plate and frame filter press and a second plate and frame filter press, a filtrate obtained by the first plate and frame filter press was subjected to step (3), a filter residue obtained was subjected to residue washing and the second plate and frame filter press sequentially, and a filtrate obtained by the second plate and frame filter press was subjected to step (3);

(3) the filtrate obtained in step (2) was mixed with metal lead to displace copper, in which an addition amount of metal lead was 0.26 times a mass of copper in the filtrate in step (2), and a solid-liquid separation was performed to obtain a first separated liquid; the first separated liquid was mixed with metal cadmium to displace lead, in which an addition amount of metal cadmium was 0.8 times a mass of lead in the first separated liquid, and a solid-liquid separation was performed to obtain a second separated liquid; the second separated liquid was mixed with metal zinc to displace cadmium, in which an addition amount of metal zinc was 9 times a mass of cadmium in the second separated liquid, and a solid-liquid separation was performed to obtain a third separated liquid;

(4) the third separated liquid obtained in step (3) was electrolyzed to obtain metal zinc, in which a pH value of an electrolytic solution was 5.5 in the electrolysis, and the electrolytic solution after the electrolysis was subjected back to step (1) to leach the zinc-containing raw material; and (5) the metal zinc obtained in step (4) was melted and cast to obtain zinc ingots and slags, in which the slags were subjected to a selection to obtain zinc ash and zinc particles, the zinc ash was subjected back to step (1) for leaching, and the zinc particles were subjected back to step (3) to displace cadmium.

In a specific embodiment of the present application, a source of the zinc-containing raw material can be zinc hypoxide powders and one or more of blast furnace dust, converter dust, electric furnace dust, and a zinc-containing solid waste containing refractory impurities such as chlorine and fluorine. A zinc content is 40%-70%, and an electrolysis condition includes a voltage of 2.35-3.5 V, a current of 200-600 A, a current efficiency of more than or equal to 94%, and a electrolytic solution temperature of 50-80° C. The metal copper, lead, cadmium and zinc prepared in Examples 1-4 were tested for purity, and results are shown in Table 1.

TABLE 1

| | Copper Purity/% | Lead Purity/% | Cadmium Purity/% | Zinc Purity/% |
|---|---|---|---|---|
| Example 1 | 54.23 | 93.87 | 80.37 | 99.997 |
| Example 2 | 55.34 | 91.87 | 82.18 | 99.996 |
| Example 3 | 54.86 | 92.49 | 85.94 | 99.995 |
| Example 4 | 56.57 | 95.12 | 83.85 | 99.998 |

It can be seen from the results in Table 1 that, by the ammonium complex system-based method provided in Examples 1-4 of the present application for separating and purifying lead, zinc, cadmium and copper, a purity of the final prepared zinc can reach more than or equal to 99.995%, a purity of the lead can reach more than or equal to 90%, and a purity of the cadmium can reach more than or equal to 80%.

The applicant has stated that although the detailed methods of the present application are illustrated by the above embodiments in the present application, the present application is not limited to the above detailed methods, which means that the present application does not necessarily rely on the above methods to be implemented.

What is claimed is:

1. An ammonium complex system-based method for separating and purifying lead, zinc, cadmium and copper, comprising:

(1) leaching a zinc-containing raw material with a leach solution, so as to obtain an extracting solution;

(2) filtering the extracting solution obtained in step (1), so as to obtain a filtrate and a filter residue;

(3) mixing the filtrate obtained in step (2) with metal lead to displace copper, and performing a solid-liquid separation to obtain a first separated liquid; mixing the first separated liquid with metal cadmium to displace lead, and performing a solid-liquid separation to obtain a second separated liquid; mixing the second separated liquid with metal zinc to displace cadmium, and performing a solid-liquid separation to obtain a third separated liquid;

(4) electrolyzing the third separated liquid obtained in step (3) to obtain metal zinc, and subjecting an electrolytic solution after the electrolysis back to step (1) to leach the zinc-containing raw material;

wherein the metal lead in step (3) is added in an amount of 0.25-0.3 times a mass of copper in the filtrate in step (2); the metal cadmium in step (3) is added in an amount of 0.5-0.8 times a mass of lead in the first separated liquid; the metal zinc in step (3) is added in an amount of 3-10 times a mass of cadmium in the second separated liquid.

2. The method according to claim 1, wherein the leach solution in step (1) comprises a complexing agent.

3. The method according to claim 2, wherein the complexing agent comprises aqueous ammonia and/or liquid ammonia.

4. The method according to claim 1, wherein a complexing agent is added to the leach solution until a pH value of the leach solution is 3.5-8.

5. The method according to claim 1, wherein a method of the filtration in step (2) is a plate and frame filter press;

optionally, the plate and frame filter press comprises a first plate and frame filter press and a second plate and frame filter press;

optionally, a filtrate obtained by the first plate and frame filter press is subjected to step (3), a filter residue obtained is subjected to residue washing and the second plate and frame filter press sequentially, and a filtrate obtained by the second plate and frame filter press is subjected to step (3).

6. The method according to claim 1, wherein the amount of metal lead added in step (3) is 0.3 times a mass of copper in the filtrate in step (2).

7. The method according to claim 1, wherein a pH value of the electrolytic solution is 3.5-8 in the electrolysis in step (4).

8. The method according to claim 1, further comprising step (5) melting and casting the metal zinc obtained in step (4) to obtain zinc ingots and slags.

9. The method according to claim 8, further comprising subjecting the slags obtained from step (5) to a selection to obtain zinc ash and zinc particles, subjecting the zinc ash to step (1) for leaching, and subjecting the zinc particles back to step (3) to displace cadmium.

10. The method according to claim 1, comprising:

(a) leaching a zinc-containing raw material with a leach solution, wherein the leach solution comprises aqueous ammonia and/or liquid ammonia, so as to obtain an extracting solution;

(b) subjecting the extracting solution obtained in step (a) to a plate and frame filter press, wherein the plate and frame filter press comprises a first plate and frame filter press and a second plate and frame filter press, a filtrate obtained by the first plate and frame filter press is subjected to step (c), a filter residue obtained is subjected to residue washing and the second plate and frame filter press sequentially, and a filtrate obtained by the second plate and frame filter press is subjected to step (c);

(c) mixing the filtrate obtained in step (b) with metal lead to displace copper, wherein metal lead is added in an amount of 0.25-0.3 times a mass of copper in the filtrate in step (b), and performing a solid-liquid separation to obtain a first separated liquid; mixing the first separated liquid with metal cadmium to displace lead, wherein metal cadmium is added in an amount of 0.5-0.8 times a mass of lead in the first separated liquid, and performing a solid-liquid separation to obtain a second separated liquid; mixing the second separated liquid with metal zinc to displace cadmium, wherein metal zinc is added in an amount of 3-10 times a mass of cadmium in the second separated liquid, and performing a solid-liquid separation to obtain a third separated liquid;

(d) electrolyzing the third separated liquid obtained in step (c) to obtain metal zinc, wherein a pH value of an electrolytic solution is 3.5-8 in the electrolysis, and subjecting the electrolytic solution after the electrolysis back to step (a) to leach the zinc-containing raw material; and (e) melting and casting the metal zinc obtained in step (d) to obtain zinc ingots and slags, wherein the slags are subjected to a selection to obtain zinc ash and zinc particles, the zinc ash is subjected back to step (a) for leaching, and the zinc particles are subjected back to step (c) to displace cadmium.

11. The method according to claim 1, wherein a mass ratio of the zinc-containing raw material to the leach solution is determined according to a Zn content of an outlet purification solution being 45-120 g/L, optionally 50-90 g/L, and further optionally 70 g/L.

12. The method according to claim 1, wherein a liquid-solid mass ratio is 8-20:1 in the leaching stage of the zinc-containing raw material.

13. The method according to claim 1, wherein the metal cadmium in step (3) is added in an amount of 0.6 times a mass of lead in the first separated liquid.

14. The method according to claim 1, wherein the metal zinc in step (3) is added in an amount of 5 times a mass of cadmium in the second separated liquid.

* * * * *